United States Patent [19]

Röck et al.

[11] Patent Number: 4,703,982

[45] Date of Patent: Nov. 3, 1987

[54] HOUSEHOLD FURNITURE DRAWER INCLUDING ADJUSTABLE PARTITIONING STRUCTURE

[75] Inventors: Erich Röck, Höchst; Felix Schwärzler, Hohenems, both of Austria

[73] Assignee: Julius Blum Gesellschaft mbH, Höchst, Austria

[21] Appl. No.: 846,814

[22] Filed: Apr. 1, 1986

[30] Foreign Application Priority Data

Apr. 25, 1985 [AT] Austria ..... 1236/85

[51] Int. Cl.[4] ..... A47B 57/58

[52] U.S. Cl. ..... 312/330 R; 312/183; 211/184

[58] Field of Search ..... 211/184, 59, 4; 220/22.1, 22.2, 22.4, 22.6; 312/183, 184, 330 R

[56] References Cited

U.S. PATENT DOCUMENTS

| | | | |
|---|---|---|---|
| 1,226,791 | 5/1917 | Manny | 220/22.4 |
| 1,367,245 | 2/1921 | Ebrenz | 211/184 X |
| 1,823,285 | 9/1931 | Petritsch | 211/184 X |
| 1,849,024 | 3/1932 | McKee | 220/22.2 |
| 2,516,713 | 7/1950 | McClure | 211/184 X |
| 3,612,292 | 10/1971 | Nervig | 211/184 |
| 3,651,950 | 3/1972 | Carter | 211/184 X |
| 3,889,816 | 6/1975 | Herryman | 211/184 X |

FOREIGN PATENT DOCUMENTS

| | | | |
|---|---|---|---|
| 348417 | 5/1921 | Fed. Rep. of Germany | 312/183 |
| 681611 | 5/1930 | France | 220/22.2 |
| 883285 | 11/1961 | United Kingdom | 211/184 |
| 1591115 | 6/1981 | United Kingdom . | |

*Primary Examiner*—Joseph Falk

*Attorney, Agent, or Firm*—Wenderoth, Lind & Ponack

[57] ABSTRACT

A drawer is subdivided by means of rod-like or frame-like separating members. The separating members extend from side wall to side wall of the drawer. Slide members, each having an arm projecting from the separating member, are arranged on the separating members. Two slide members together form a cruciform part or shape. The separating members are slideable in the drawer and have releaseable clamps.

2 Claims, 5 Drawing Figures

HOUSEHOLD FURNITURE DRAWER INCLUDING ADJUSTABLE PARTITIONING STRUCTURE

FIELD AND BACKGROUND OF THE INVENTION

The invention relates to a drawer having subdivisions in the form of one or several separating members extending from one drawer wall to another, and slide members each having at least one arm projecting from the separating member being arranged on the separating member or members.

It is known to provide subdivisions or partitions in kitchen drawers as well as in drawers adapted for storing material, so that a number of separate containers or compartments are obtained.

The separating walls of such compartments may be displaceable within the drawer to obtain compartments of different size.

SUMMARY OF THE INVENTION

It is the object of the invention to provide a drawer with subdivisions or partitions which is particularly suitable for kitchen furniture and has the advantage that the kinds of subdivisions may be chosen within a wide range and that a change of the subdivisions is very simple.

According to the invention this is achieved in that two slide members which form together a cruciform part or shape and have arms extending in opposite directions are arranged on at least one separating member.

To obtain an optimal arrangement in which the slide members match, the slide members are advantageously provided with stop or abutment edges which are complementary to one another and which extend at an angle of 45° with respect to the push-in direction of the drawer.

The slide members are advantageously arranged on the separating members in a rider-like clamping manner but nevertheless are easily slideable thereon.

The slide members do not produce closed containers, which are not necessarily desired within the scope of the present invention, but rather delimited compartments into which bottles, opened tins and the like may be placed, for example. The bottles or tins are in this arrangement held by the slide members and by the separating members so that tilting thereof is prevented.

BRIEF DESCRIPTION OF THE DRAWINGS

In the following two embodiments of the invention will be described in more detail with reference to the accompanying drawings, in which.

DESCRIPTION OF THE PREFERRED EMBODIMENTS

Figure 1:
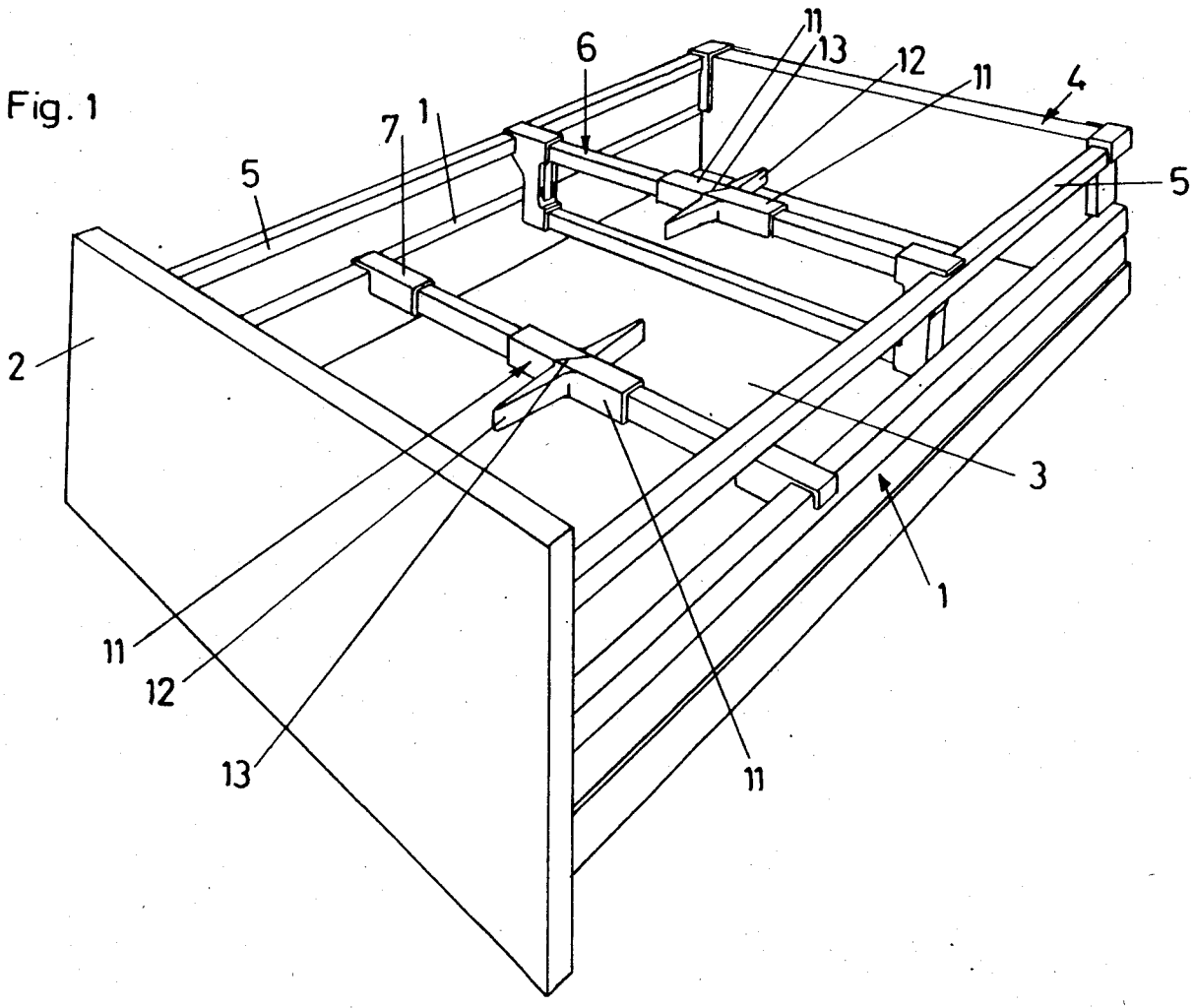
FIG. 1 is a perspective schematic view of a drawer according to the invention.

As can be seen from FIG. 1, the drawer according to the invention comprises opposite side walls 1, a front plate 2, a bottom plate 3 and a rear wall 4.

Above each side wall, a rail member 5 extends from the front plate 2 to the rear wall 4 of the drawer.

Two separating members 6,7 are shown in FIG. 1. In practice, any desired number of separating members may be arranged in the drawer. Different separating members 6,7 are shown in FIG. 1. In a drawer comprising rail members 5, only separating members 6 are employed, and the separating members 7 are advantageously used in drawers without rail members.

Both separating members 6,7 are shown with the one drawer of FIG. 1 to simplify illustration thereof.

Figure 2:
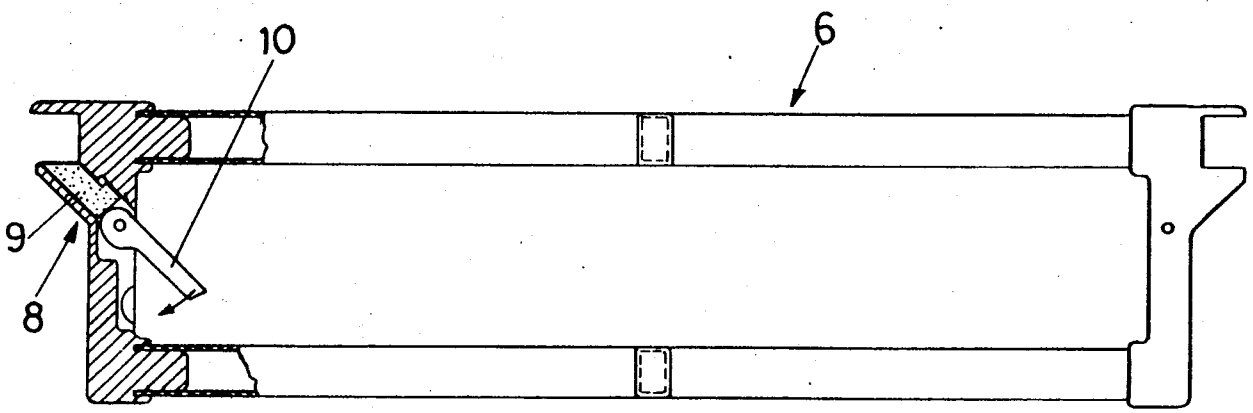
FIG. 2 is a front view of a first embodiment of a separating member, parts thereof being shown in section.
Figure 3:
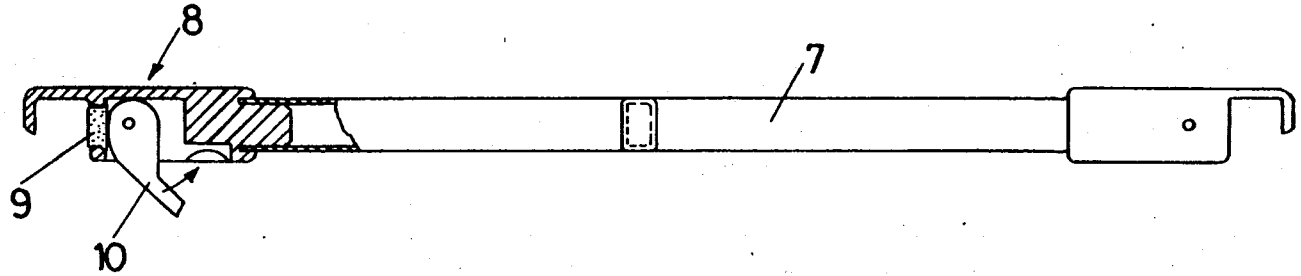
FIG. 3 is a similar view of a second embodiment of a separating member.
Figure 5:
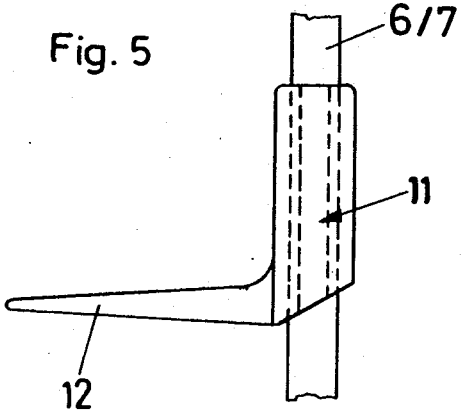
FIG. 5 is a top view of the slide member according to the invention.
Figure 4:
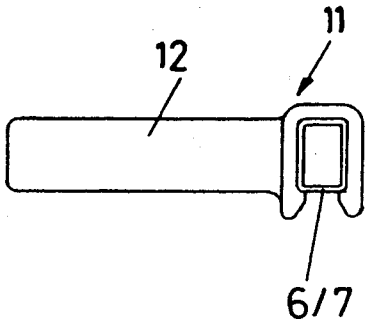
FIG. 4 is a side view of a slide member according to the invention.

As can be seen from FIGS. 2, 3, both separating members 6,7 may be provided with a releasable clamping means 8. The releasable clamping means 8 comprises a braking member 9 and an eccentric pivot lever 10 pressing thereon. FIGS. 2 and 3 each show the released position of the clamping means 8, i.e. in this position of the clamping means 8 and of the pivot lever 10, the respective separating member 6,7 can be displaced along the rail member 5 or along the drawer side wall 1, respectively. When the separating member 6,7 is in the desired position, the pivot lever 10 is pivoted in the direction of the arrow and, hence, the braking member 9 is pressed against the rail member 5 or the drawer side wall 1, respectively.

Because the drawer side walls 1 are advantageously made of plastics material or of coated metal, the braking member 9 is obviously also made of a material which adheres well to the afore-mentioned materials.

In the locked position, the pivot lever 10 is fully received within the separating member 6,7. Hence, there are no projecting parts.

In the embodiment illustrated in FIG. 1, two slide members 11 are clamped onto each separating member. Each slide member 11 has a dividing arm 12 which projects from the separating member 6,7.

When two slide members 11 are pushed together on a separating member 6,7, they form a cross or a star-shaped part, as shown in FIG. 1.

To obtain this arrangement in which the slide members 11 match, they are provided with corresponding stop edges 13 which are inclined at an angle of 45°.

By suitable displacement of the separating members 6,7 and a corresponding arrangement of the slide members 11, a great variety of subdivisions can be obtained in each drawer.

In the illustrated embodiment, the separating members 6,7 are rod-like or frame-like. The slide members 11 are therefore mounted on a rod-like or bar-like part.

What is claimed is:

1. In a household furniture drawer including a bottom wall and spaced side walls and being insertable into a furniture body in an insertion direction parallel to said side walls, the improvement of means for partitioning the area of said drawer between said side walls into a plurality of compartments of selectively adjustable size and number, with the boundaries of each said compartment being delimited but with each said compartment being open and connected to adjacent said compartments, said partitioning means comprising:

at least one separating member extending between said side walls and selectively movable therealong in opposite directions parallel thereto, said separating member having substantially a bar-like construction;

each said at least one separating member having mounted thereon, for selective sliding movement in opposite directions transverse to said side walls, at least two slide members, each said slide member having extending therefrom, in a direction generally parallel to said insertion direction and to said side walls, a dividing arm;

said two slide members being mounted on said separating member with said dividing arms extending in opposite directions, and said two slide members having complementary abutting surfaces such that, upon sliding said two slide members toward each other along said separating member until said abutting surfaces thereof are in contact, said two slide members and said dividing arms thereof define a cruciform shape partitioning said area of said drawer into at least four said compartments; and said separating member, said two slide members and said arms being spaced above said bottom wall.

2. The improvement claimed in claim 1, wherein said abutting surfaces extend at angles of 45° with respect to said side walls.

* * * * *